US005904397A

United States Patent [19]

Fismen

[11] Patent Number: 5,904,397

[45] Date of Patent: May 18, 1999

[54] SEATING UNIT COMPRISING TWO ADJACENT, PIVOTAL SUPPORT ELEMENTS

[75] Inventor: Olav H. Fismen, Risør, Norway

[73] Assignee: Hag A/S, Nansens Vei, Norway

[21] Appl. No.: 08/945,191

[22] PCT Filed: Apr. 30, 1996

[86] PCT No.: PCT/IB96/00495

§ 371 Date: Oct. 23, 1997

§ 102(e) Date: Oct. 23, 1997

[87] PCT Pub. No.: WO96/34547

PCT Pub. Date: Nov. 7, 1996

[30] Foreign Application Priority Data

May 2, 1995 [DE] Germany ..... 0512

[51] Int. Cl.[6] ..... A47C 3/025

[52] U.S. Cl. ..... 297/291; 297/296; 297/297; 297/312; 297/313; 403/223; 403/291; 403/292; 267/153

[58] Field of Search ..... 297/291, 296, 297/297, 298, 312, 313; 403/223, 224, 291, 292, 298; 267/153, 79

[56] References Cited

U.S. PATENT DOCUMENTS

| | | | |
|---|---|---|---|
| 3,057,660 | 10/1962 | Schneider | 297/312 |
| 3,712,666 | 1/1973 | Stoll | 297/313 X |
| 4,498,702 | 2/1985 | Raftery | 297/312 |
| 4,549,764 | 10/1985 | Haedo | 297/296 |
| 4,603,904 | 8/1986 | Tolleson | 297/296 |
| 4,869,552 | 9/1989 | Tolleson | 297/296 |
| 5,039,163 | 8/1991 | Tolleson | 297/297 |
| 5,108,149 | 4/1992 | Ambasz | 297/297 X |

FOREIGN PATENT DOCUMENTS

| | | | |
|---|---|---|---|
| 302759 | 2/1989 | European Pat. Off. | 297/296 |
| 72037 | 12/1986 | Finland . | |
| 2038174 | 7/1980 | United Kingdom | 297/296 |
| 9103192 | 3/1991 | WIPO | 297/296 |

*Primary Examiner*—Peter M. Cuomo
*Assistant Examiner*—Rodney B. White
*Attorney, Agent, or Firm*—Ladas & Parry

[57] ABSTRACT

A seating unit having two adjacent and mutually pivotal support elements 3, 4) pivotal between an initial position and a maximum flexed position. A spring element (12) is secured between the support elements (3, 4) and biases the support elements (3, 4) into the initial position. The spring element (12) comprises a base member (13) arranged in an area between the support elements (3, 4). At least one engagement element extends from the base member (13) into cavity (14, 15) in one of the support elements (3, 4) such that the support elements (3, 4) may pivot relative to each other. The engagement element is provided with a rigid stop (17, 17') projecting from the base member (13) to define the maximum flexed position of the support elements. The engagement element is further provided with a leaf spring (18, 18'; 68) to restore the support elements (3, 4) to their initial position.

12 Claims, 4 Drawing Sheets

SEATING UNIT COMPRISING TWO ADJACENT, PIVOTAL SUPPORT ELEMENTS

TECHNICAL FIELD

The invention relates to a seating unit comprising two adjacent and mutually pivotal support elements pivotal around an axis between an initial position and a maximal flexed position and a spring element secured between the support elements and provided with a leaf spring-like means biassing the support elements into the initial position, the spring element comprising a base member arranged in the adjacent area of the support elements and engagement means provided on each side of the base member and engaging each their own support element at least one engagement means extending from the base member and into a cavity in one of the support elements such that the support elements may pivot relative to each other.

BACKGROUND ART

Seating units having a pivotal, flexible, upper backrest element and/or a front, pivotal, flexible seat element are known to enhance the seating comfort when the user adopts different sitting postures.

Thus, U.S. Pat. No. 4,498,702 discloses a seating unit having a front seat element connected to the rest of the seat by means of two interspaced leaf springs maintaining the front seat element in an initial position. When the front seat element is loaded, it may flex downwardly to a maximum flexed position determined by means of a separate stop.

Furthermore, U.S. Pat. No. 4,603,904 discloses a seating unit comprising a lower backrest frame part formed of two upstanding frame members and an upper backrest frame part formed of two upstanding frame members arranged in continuation in the lower frame members. A flexible spring element is secured between the two pairs of the frame members to provide a flexing of the upper backrest frame part and thus of the backrest relative to the lower backrest frame part. Each flexible spring element comprises a plastic strut provided with a centrally arranged wire and maintaining the strut under compression and limiting the elongation thereof, when the backrest is loaded during use of the seating unit.

Finally, U.S. Pat. No. 4,869,552 and U.S. Pat. No. 5,039,163 both disclose a seating unit of the above type except that the flexible spring elements between the two backrest parts each comprises a leaf spring whose opposite ends are fixed to each their own U-shaped holder members at the inner end thereof, one open end thereof facing toward the other. At the open ends the holder members are provided with restrictive flanges extending laterally outwardly and adapted to interengage to define the maximum flexed position between the two backrest frame parts.

BRIEF DESCRIPTION OF THE INVENTION

The object of the invention is to provide a seating unit of the above type comprising a simply shaped spring element to define the initial position and the maximum flexed position of the two support elements.

The seating unit according to the invention is characterised in that said at least one engagement means is provided with a rigid stop means projecting from the base member and being pivotally received in the associated cavity for defining the maximum flexed position by abutting one inner face (21,21') of the cavity, and that in order to bias the support elements (3,4) into their initial positionthe spring means (18, 18'; 68) of said at least one engagement means is provided with a free end co-acting with said one inner face (21,21') abutting the stop means in the maximum flexed position.

In that the projecting engagement means of the spring element and thus its stop means and spring means all are received in a cavity and thus in effect concealed, many options as to the shape and dimensioning of these are rendered without effecting the appearance of the seating unit.

According to the invention, in order to define the initial position the stop means may be adapted to abut an inner face of the cavity opposite the inner face of the cavity it abuts in the maximum flexed position and the spring means may be prestressed in the initial position. It is thus ensured that the support elements only pivot in the desired direction relative to each other and that due to the spring loading of the spring means said elements always revert to their initial position when they are not loaded, even if the spring means gradually might lose some of its elastic force.

Moreover, according to the invention the leaf spring-like means may advantageously be slightly curved in its initial position, by being bowed away from the inner cavity face with which it co-acts. Due to its slightly curved state, when stressed the leaf spring-like member is straightened and its length thus increased. The feature is particularly advantageous in a further embodiment of the invention in which the spring means is in retaining engagement with the inner cavity face with which it co-acts.

Furthermore, according to the invention the engagement means of the spring element may be provided with outer guide faces being perpendicular to the pivot axis and adapted to co-act with opposite guide faces of the cavity for a controlled flexing of the respective support element in relation to the projecting stop means.

Moreover, according to the invention the stop means may be formed of two interspaced legs extending from the base member, the spring means being arranged therebetween.

According to the invention the spring element may further be provided with engagement means projecting from each side of the base member and received in a respective cavity of the two support elements. Consequently, the flexing of the support elements relative to each other is obtained by a flexing of each support element relative to the stop means of the engagement means interengaging said element. Correspondingly, the deformation of the spring element caused by the flexing is shared by the spring means of the two engagement means. This embodiment is particularly advantageous with a view to maintaining the ability of the spring element to restore the support elements to their initial position.

Finally, in connection with the above embodiment of the invention the spring element may advantageously be shaped symmetrically reversed in relation to the base member.

The invention further relates to a spring element for use in a seating unit comprising two adjacent and mutually pivotal support elements pivotal around an axis between an initial position and a maximal flexed position, said spring being provided with a leaf spring-like means adapted to bias the support elements into the initial position, the spring element comprising a base member adapted to be arranged in an area between the support elements and engagement means provided on each side of the base member and adapted to interengage support element, at least one engagement means extending from the base member to be received such in a cavity in one of the support elements so that the support elements may pivot relative to each other.

The spring element according to the invention is characterised in that said at least one engagement means is provided with a rigid stop means projecting from the base member and being pivotally received in the associated cavity for defining the maximum flexed position by abutting one inner face of the cavity, and that in order to bias the support elements into their initial position the spring means of said at least one engagement means is provided with a free end co-acting with said one inner face abutting the stop means in the maximum flexed position.

BRIEF DESCRIPTION OF THE DRAWINGS

The invention is described in greater detail in the following with reference to the particularly preferred embodiments and accompanying drawings, in which.

BEST MODE FOR CARRYING OUT THE INVENTION

Figure 1:
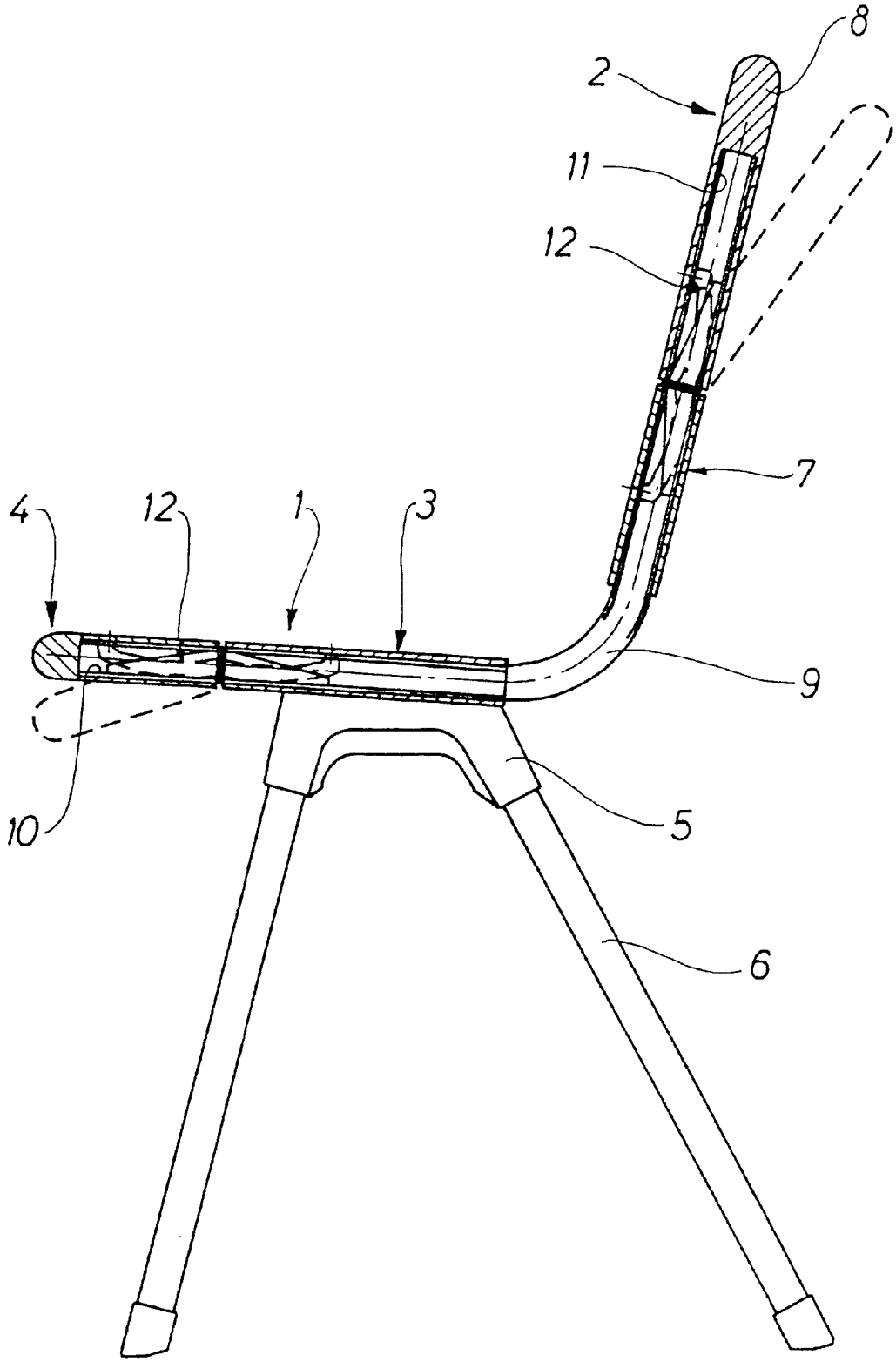
FIG. 1 illustrates a seating unit according to the invention in the form of a chair comprising two seat elements pivotal relative to each other and two back elements pivotal relative to each other, seen partly in a side elevational view and partly in section.
Figure 3:
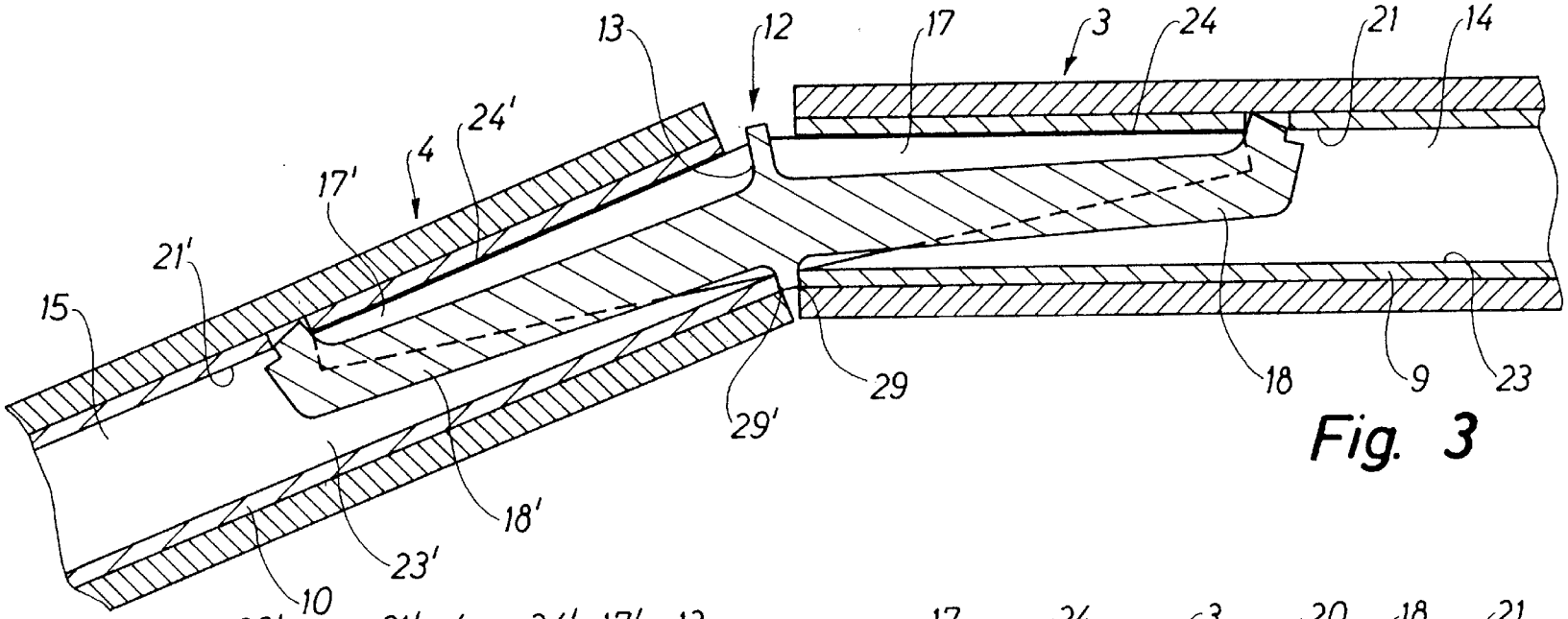
FIG. 3 is a vertical, partly sectional view through the two seat elements in a maximum flexed position.

The chair shown in FIG. 1 comprises a seat 1 and a back 2. The seat comprises a main seat element 3 and an outer seat element 4 pivotal relative hereto. The main seat element 3 is fixedly connected with a seat support 5 wherefrom four legs 6 extend downwardly. The back 2 comprises a lower back element 7 and an upper back element 8 pivotal relative thereto. The main seat element 3 and the lower back element 7 are interconnected by means of a frame element comprising two interspaced, bent tubes 9 of a square section. Each tube 9 extends through the entire main seat element 3 at one end and through the entire lower back element 7 at the other end. In registry with the tubes 9 two interspaced tubes 10 are arranged in the outer seat element 4. Correspondingly, in registry with the tubes 9 two interspaced tubes 11 are arranged in the upper back element 2. In the adjacent area of the two seat elements 3,4 and the two back elements 7,8, a spring element 12 is arranged between the cavities formed by the tubes 9, 10 and 9, 11 respectively. The spring element 12 is described in detail with reference to the spring element arranged between the seat elements 3, 4, as the spring element arranged between the back elements 7, 8 is formed in a corresponding manner.

Figure 2:
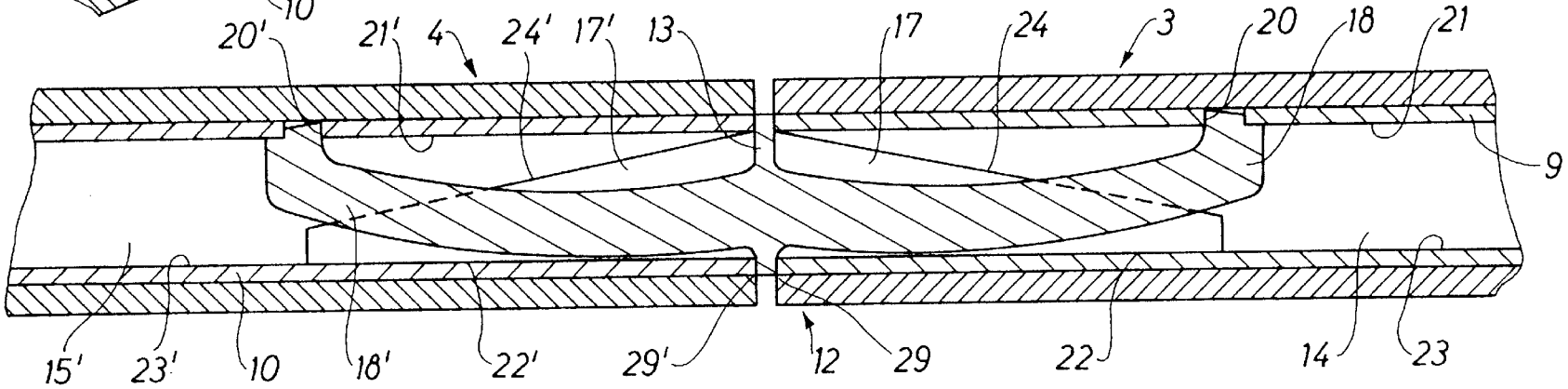
FIG. 2 is a vertical, partly sectional view on an enlarged scale through the two seat element in an initial position and from which a spring element according to the invention also appears.
Figure 4:
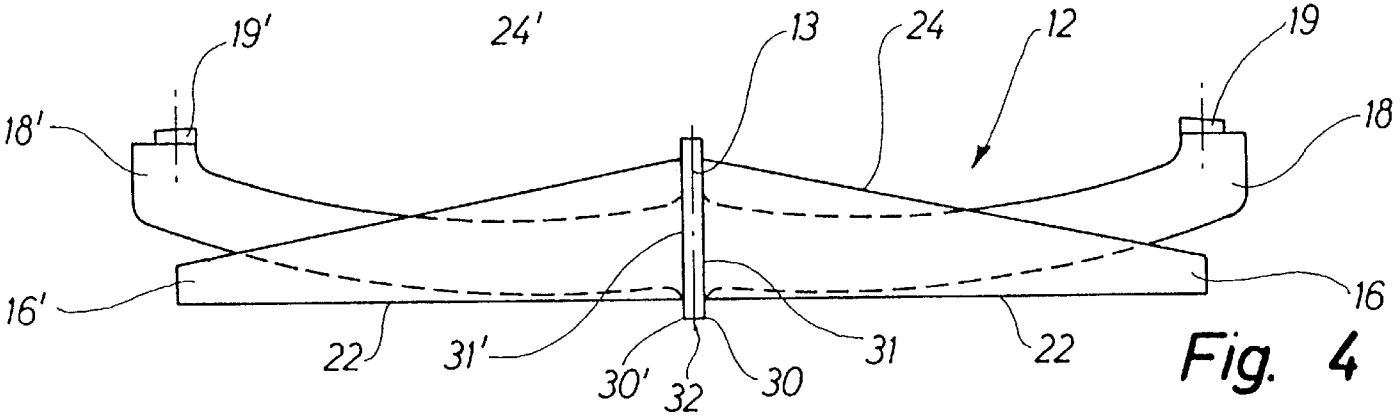
FIG. 4 is a side elevational view of the spring element according to the invention.
Figure 5:
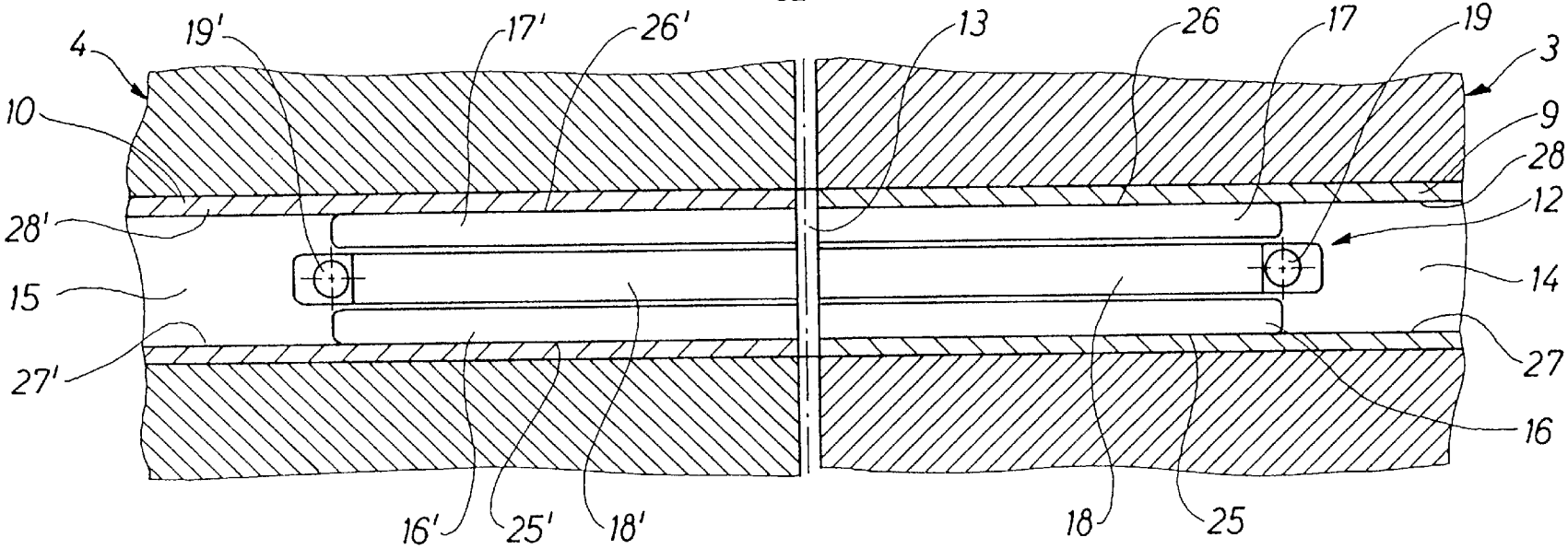
FIG. 5 is a top view of the spring element according to the invention, the spring element being arranged between the two seat elements shown in section.

As it appears from FIGS. 2 to 5 the spring element 12 comprises a disk-like, rectangular base member 13 abutting in the initial position shown in FIGS. 2 and 5 the edge by the cavity 14 and 15 respectively formed of the tubes 9 and 10 in the main seat element 3 and the outer seat element 4. The spring element 12 is shaped symmetrically reversed around the base member 13 and an engagement means extends into the two cavities 14,15 from each side of said base member. Each engagement means comprises two interspaced, rigid legs 16,16',17,17' and a leaf spring-like means 18, 18' arranged between said legs. At its outer end each leaf spring-like 18, 18' is provided with a projection 19, 19' engaging a recess 20, 20' in the upper face 21,21' of the cavity 14, 15. When comparing FIG. 2 with FIG. 4, it appears that the leaf spring-like means 18, 18' of the spring element 12 are prestressed and act to bring the two seat elements 3,4 into the initial position shown in FIG. 2.

For definition of the initial position, the lower edge faces 22, 22' of the legs 16, 16', 17, 17' abut the lower surfaces 23, 23' of the cavities 14, 15. The seat ele25 ments 3,4 may pivot relative to each from the initial position to a maximum flexed position shown in FIG. 3, the force from the leaf spring-like means 18,18' being overcome. The upper edge faces 24, 24' of the legs 16, 16'; 17, 17' abut the upper surface 21,21' of the cavities 14,15 in the maximum flexed position.

Moreover, each leg 16, 17, 16', 17' comprises an outer lateral face 25, 26, 25', 26'abutting a respective lateral face 27, 28, 27', 28' of each cavity 14, 15. The lateral faces act as guide faces when the two seat elements 3,4 are flexed relative to each and thus when the legs 16, 16', 17, 17' of the engagement means are pivoted relative to the cavities 14,15 of the seat elements 3,4.

The pivoting/flexing between the two seat elements 3, 4 takes place around two parallel axes 29, 29' defined by the two transverse edges 30, 30' between the lateral faces 31, 31' of the base member 13 and its lower edge face 32. During flexing the leaf spring-like means 18,18' being slightly curved in their initial position (bowed away from inner faces 21, 21') are straightened, whereby these are essentially rectilinear in the maximum flexed position. Due to the straightening of the leaf spring-like means 18, 18' the distance between the engagement point of the spring means 18, 18' with the cavity 14, 15 (defined by the engagement of the projection 19,19' with the recess 20, 20') and the axis 29,29' respectively remains essentially constant during the flexing.

The spring element 12 is made integrally of plastic, preferably of reinforced plastic, e.g. glass fibre reinforced polyamide containing e.g. 30% glass fibres.

Figure 6:
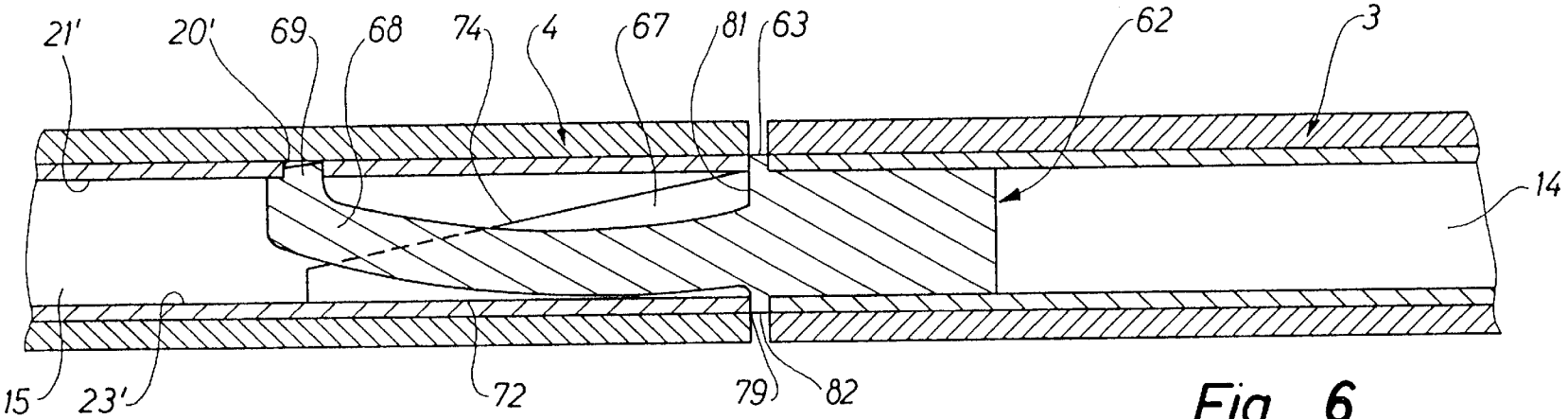
FIG. 6 is the same partly sectional view as in FIG. 2 through two mutually pivotal seat elements in their initial position, a second embodiment of the spring element according to the invention being secured therebetween, and FIG. 7 corresponds to FIG. 3 and illustrates the seat elements shown in FIG. 6 in their maximum flexed position.
Figure 7:
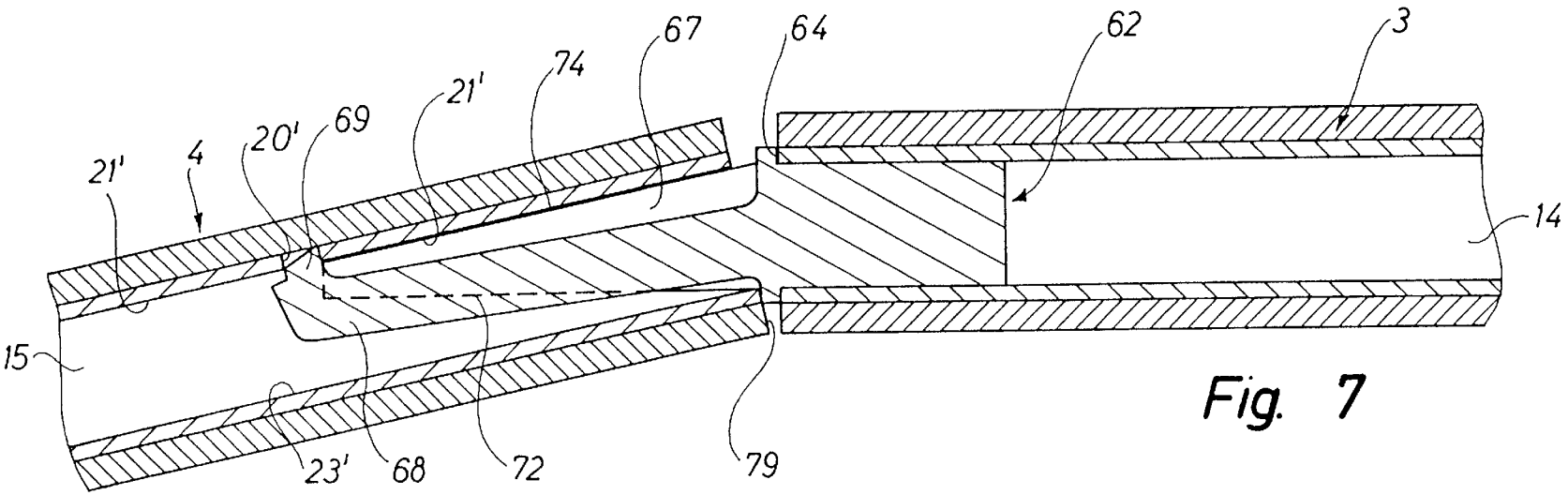

The embodiment of a spring element 62 shown in FIGS. 6 and 7 is secured between two seat elements 3, 4 formed as shown in FIGS. 1 to 5, for which reason these are not described further. The spring element 62 is provided with a first engagement means extending from the side of the base member 63 shown on the right-hand side of the Figure and is in retaining engagement with the cavity 14 in the seat element 3. A second engagement means extends from the other side of the base member 63, i.e. shown on the left-hand side on the Figure, to engage the cavity 15 in the seat element 4. This second engagement means is shaped in a manner corresponding to the engagement means of the spring element 12 described above. The second engagement means thus comprises two interspaced, rigid legs 67 extending from the base member 63 and a leaf spring-like means 68 arranged therebetween and also extending from the base member 63. The leaf spring-like means 68 engages the recess 20' in the upper surface 21' of the cavity by means of a projection 69 provided at its outer end. Each leg 67 is provided with a lower edge face 72 engaging the lower surface 23' of the cavity 15 in its initial position. Furthermore, each leg is provided with an upper edge face 74 engaging the upper surface 21' of the cavity 15 in its maximum flexed position shown in FIG. 7.

As the engagement means engaging the main seat element 3 is firmly interconnected therewith, the pivoting/flexing between the two seat elements 3,4, only takes place between the seat element 4 and the rigid legs 72 of the second engagement means around an axis 79. As described above, the axis 79 is defined by a transverse, lower edge between the lower edge face 82 of the base member 63 and the lateral face 81 of the base member 63 from which the rigid legs 67 and the leaf spring-like means 68 extend.

The spring element 62 is likewise made integrally of plastic, preferably reinforced plastic, such as polyamide containing e.g. 30% glass fibres.

What is claimed is:

1. A seating unit comprising two adjacent and mutually pivotal support elements (3, 4) pivotal around an axis between an initial position and a maximum flexed position and a spring element (12; 62) secured between the support elements (3, 4) and provided with a leaf spring means (18, 18'; 68) biassing the support elements (3, 4) into the initial position, the spring element (12; 62) comprising a base member (13; 63) arranged in an area between the two adjacent support elements (3, 4) and engagement means provided on each side of the base member and engaging respective support elements (3, 4), at least one engagement means extending from the base member (13; 3) and into a cavity (15) in one of the support elements (4) such that the support elements (3, 4) may pivot relative to each other, characterized in that said at least one engagement means is provided with a rigid stop means (16, 17, 16', 17'; 67) projecting from the base member and being pivotally received in said cavity (14, 15) for defining the maximum flexed position by abutting a first inner face (21, 21') of the cavity (14, 15), that in order to bias the support elements (3, 4) into their initial position, the leaf spring means (18, 18'; 68) is provided with a free end co-acting with said first inner face (21, 21') abutting the stop means in the maximum flexed position, and that in order to define said initial position, said stop means is adapted to abut a second inner face (23, 23') of the cavity opposite the first inner face (21, 21') of the cavity (14, 15), said spring means (18, 18'; 68) being prestressed in said initial position.

2. A seating unit as claimed in claim 1, characterised in that in order to define the initial position the stop means is adapted to abut an inner face (23,23') of the cavity opposite the inner face (21, 21') of the cavity (14, 15) it abuts in the maximum flexed position and that the spring means (18, 18'; 68) is prestressed in the initial position.

3. A seating unit as claimed in claim 1, characterised in that in said initial position, the leaf spring means (18, 18'; 68) is slightly bowed away from said first inner face (21, 21') of said cavity.

4. A seating unit as claimed in claim 1, characterised in that the spring means (18, 18'; 68) is in retained engagement with the first inner cavity face (21, 21').

5. A seating unit as claimed in claim 1 characterised in that the engagement means of the spring element (12,62) is provided with outer guide faces (25,26, 25', 26) being perpendicular to the pivot axis and adapted to co-act with opposite guide faces (27, 28, 27', 28') of said cavity (14, 15) for a controlled flexing of the respective support element (3,4) in relation to the projecting stop means (16, 17, 16', 17'; 67).

6. A seating unit as claimed in claim 1, characterised in that the stop means is formed of two interspaced legs (16, 16', 17'; 67) extending from the base member (13;63), the spring means (18, 18'; 68) being arranged therebetween.

7. A seating unit as claimed in claim 1, characterised in that the spring element (12) is provided with engagement means projecting from each side of the base member (13) and received in a respective said cavity (14,15) of the two support elements (3,4).

8. A seating unit as claimed in claim 7, characterised in that the spring element (12) has a symmetrically reversed shape in relation to the base member (13).

9. A spring element (12, 62) for use in a seating unit comprising two adjacent and mutually pivotal support elements (3, 4) pivotal around an axis between an initial position and a maximum flexed position, said spring element being provided with a leaf spring means (18, 18'; 68) adapted to bias the support elements (3, 4) into the initial position, the spring element (12; 62) comprising a base member (13; 63) adapted to be arranged in an area between the two adjacent support elements (3, 4) and engagement means provided on each side of the base member (13, 63) and adapted to engage said support elements (3, 4), at least one engagement means extending from the base member (13; 63) so as to be received in a cavity (14, 15) in one of the support elements (3, 4) such that the support elements (3, 4) may pivot relative to each other, characterised in that said at least one engagement means is provided with a rigid stop means (16, 17, 16', 17';67) projecting from the base member and being pivotally received in a respective cavity (14, 15) for defining the maximum flexed position by abutting a first inner face (21, 21') of the respective cavity (14, 15), that in order to bias the support elements (3, 4) into their initial position the spring means (18, 18'; 68) of said at least one engagement means is provided with a free end for co-acting with said first inner face (21, 21') abutting the stop means in the maximum flexed position, and that in order to define the initial position, the stop means is adapted to abut a second inner face of the associated cavity opposite said first inner face, the spring means being prestressed in the initial position.

10. A spring element as claimed in claim 9, characterised in that the stop means is formed by two interspaced legs (16, 16', 17'; 67) extending from the base member (13; 63), the spring means (18, 18'; 68) being arranged therebetween.

11. A spring element as claimed in claim 9, characterised in that the spring element (2) is provided with engagement means projecting from each side of the base member (13).

12. A spring element as claimed in claim 9, characterised in that the spring element (2) has a symmetrically reversed shape in relation to the base member (13).

* * * * *